United States Patent [19]

Carter, Jr.

[11] Patent Number: 4,502,537

[45] Date of Patent: Mar. 5, 1985

[54] ANNULAR SAMPLE CHAMBER, FULL BORE, APR ® SAMPLER

[75] Inventor: Ernest E. Carter, Jr., Duncan, Okla.

[73] Assignee: Halliburton Services, Duncan, Okla.

[21] Appl. No.: 535,083

[22] Filed: Sep. 23, 1983

[51] Int. Cl.[3] ..... E21B 49/08; E21B 34/10

[52] U.S. Cl. ..... 166/162; 166/152; 166/167; 166/264; 166/317; 166/323; 166/332

[58] Field of Search ..... 166/162, 165, 166, 167–169, 166/150, 152, 264, 317, 319, 323, 332, 373, 386

[56] References Cited

U.S. PATENT DOCUMENTS

| | | | |
|---|---|---|---|
| 964,578 | 7/1910 | Stephens | 285/276 |
| 3,065,796 | 11/1962 | Nutter | 166/150 |
| 3,358,755 | 12/1967 | Chisholm | 166/165 |
| 3,456,726 | 7/1969 | Barrington et al. | 166/169 |
| 4,270,610 | 6/1981 | Barrington | 166/317 |

*Primary Examiner*—James A. Leppink
*Assistant Examiner*—Hoang C. Dang
*Attorney, Agent, or Firm*—Thomas R. Weaver; James R. Duzan

[57] ABSTRACT

An annulus pressure responsive sampler valve comprising a power section and a sampler section having an annular sample chamber therein; the sampler valve having a full bore therethrough.

19 Claims, 9 Drawing Figures

ANNULAR SAMPLE CHAMBER, FULL BORE, APR ® SAMPLER

BACKGROUND OF THE INVENTION

The present invention relates to an improved annulus pressure responsive sampling apparatus for use in the sampling of well formation fluids in the testing of oil wells.

Various tester valves, circulation valves and sampler valves for testing oil wells have been developed which are responsive to changes in the annulus pressure of the fluid between the well bore and the testing string for the opening and closing of the various valves. These various annulus pressure responsive valves are useful, particularly in offshore testing operations, where it is desired to manipulate the various valves in the testing string without utilizing reciprocation of the testing string thereby allowing the blow-out preventers to remain closed about the testing string.

Typical prior art annulus pressure responsive valves which may be used as sampler valves for obtaining a sample of the formation fluids during the formation testing procedure are described in U.S. Pat. Nos. 3,664,415; 3,858,649; 3,964,305; 4,047,564; 4,064,937 and 4,063,593. An example of an annulus pressure responsive valve which is used as a circulating valve in a formation testing string is described in U.S. Pat. No. 4,311,197.

Other types of sampler valves are described in U.S. Pat. No. 3,969,937 and in Halliburton Services Sales and Service Catalog Number 41 on pages 3986, 3987 and 3988 therein.

Also, in wells where high formation pressures and flow rates are encountered along with sour gas, hydrogen sulfide ($H_2S$), being present it is desirable to have an annulus pressure responsive sampler valve which is designed to catch and retrieve samples of formation fluids under such conditions. It is further desirable to have an annulus pressure responsive sampler valve which has an unrestricted bore therethrough after catching a sample of formation fluids so that formation fluids recovered during testing operations may be injected back into the formation or other operations may occur as desired. This is particularly desirable in environmentally sensitive areas where the surface disposal of formation fluids is a problem or prohibited.

STATEMENT OF THE INVENTION

The present invention is directed to an annulus pressure responsive sampler valve for use in the sampling of well formation fluids in the testing of oil wells; i.e., formation fluids including both liquids and gases. The annulus pressure responsive sampler valve comprises a power section and sampler section having an annular sample chamber therein, the sampler valve having a full bore therethrough.

The sampler valve of the present invention further comprises a lower thread protecting transport cap and upper sleeve locking transport cap for use in transporting the formation fluid sample from the drilling rig floor to be transferred to an approved chamber for transportation to the laboratory for analysis or for placing a portion of the sampler valve into a warm liquid bath to warm the formation fluid sample prior to removal from the sampler valve.

BRIEF DESCRIPTION OF THE DRAWINGS

The advantages of the present invention will be more fully understood from the following description and drawings wherein.

DESCRIPTION OF THE INVENTION

During the course of drilling an oil well, the borehole is filled with a fluid known as drilling fluid or drilling mud. One of the purposes of this drilling fluid is to contain in intersected formations any fluid, fluid being either liquid or gas or both, which may be found there. To contain these formation fluids the drilling mud is weighted with various additives so that the hydrostatic pressure of the mud at the formation depth is sufficient to maintain the formation fluid within the formation without allowing it to escape into the borehole.

When it is desired to test the production capabilities of the formation, a testing string is lowered into the borehole to the formation depth and the formation fluid is allowed to flow into the string in a controlled testing program. Lower pressure is maintained in the interior of the testing string as it is lowered into the borehole. This is usually done by keeping a valve in the closed position near the lower end of the testing string. When the testing depth is reached, a packer is set to seal the borehole thus closing in the formation from the hydrostatic pressure of the drilling fluid in the well annulus.

The valve at the lower end of the testing string is then opened and the formation fluid, free from the restraining pressure of the drilling fluid, can flow into the interior of the testing string.

The testing program includes periods of formation flow and periods when the formation is closed in. Pressure recordings are taken throughout the program for later analysis to determine the production capability of the formation. If desired, a sample of the formation fluid may be caught in a suitable sample chamber.

At the end of the testing program, a circulation valve in the test string is opened, formation fluid in the testing string is circulated out, the packer is released, and the testing string is withdrawn.

Over the years various methods have been developed to open the tester valves located at the formation depth as described. These methods include string rotation, string reciprocation, and annulus pressure changes. One particularly advantageous tester valve is that shown in U.S. Pat. No. 3,856,085 to Holden, et al. This valve operates responsive to pressure changes in the annulus and provides a full opening flow passage through the tester valve apparatus.

The annulus pressure operated method of opening and closing the tester valve is particularly advantageous in offshore locations where it is desirable to the maximum extent possible, for safety and environmental protection reasons, to keep the blowout preventers closed during the major portion of the testing procedure.

Figure 1:
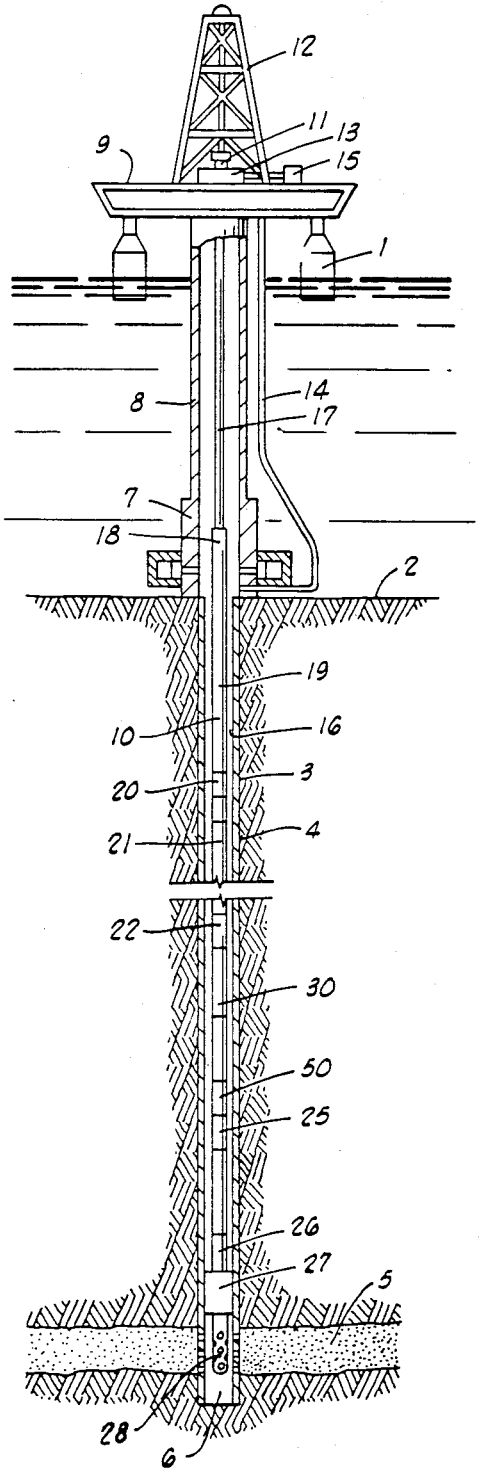
FIG. 1 is a schematic elevational view of typical well testing apparatus using the present invention therein.

A typical arrangement for conducting a drill stem test offshore is shown in FIG. 1. Such an arrangement would include a floating work station 1 stationed over a submerged work site 2. The well comprises a well bore 3 typically lined with a casing string 4 extending from the work site 2 to a submerged formation 5. The casing string 4 includes a plurality of perforations at its lower end which provide communication between the formation 5 and the interior of the well bore 6.

At the submerged well site is located the well head installation 7 which includes blowout preventer mechanisms. A marine conductor 8 extends from the well head installation to the floating work station 1. The floating work station includes a work deck 9 which supports a derrick 12. The derrick 12 supports a hoisting means 11. A well head closure 13 is provided at the upper end of marine conductor 8. The well head closure 13 allows for lowering into the marine conductor and into the well bore 3 a formation testing string 10 which is raised and lowered in the wall by hoisting means 11.

A supply conduit 14 is provided which extends from a hydraulic punp 15 on the deck 9 of the floating station 1 and extends to the well head installation 7 at a point below the blowout preventers to allow the pressurizing of the well annulus 16 surrounding the test string 10.

The testing string includes an upper conduit string portion 17 extending from the work site 1 to the well head installation 7. A hydraulically operated conduit string test tree 18 is located at the end of the upper conduit string 17 and is landed in the well head installation 7 to thus support the lower portion of the formation testing string. The lower portion of the formation testing string extends from the test tree 18 to the formation 5. A packer mechanism 27 isolates the formation 5 from fluids in the well annulus 16. A perforated tail piece 28 is provided at the lower end of the testing string 10 to allow fluid communication between the formation 5 and the interior of the tubular formation testing string 10.

The lower portion of the formation testing string 10 further includes intermediate conduit portion 19 and torque transmitting pressure and volume balanced slip joint means 20. An intermediate conduit portion 21 is provided for imparting packer setting weight to the packer mechanism 27 at the lower end of the string.

It is many times desirable to place near the lower end of the testing string a conventional circulating valve 22 which may be opened by rotation or reciprocation of the testing string or a combination of both or by the dropping of a weighted bar in the interior of the testing string 10. Also near the lower end of the formation testing string 10 is located a tester valve 25 which is preferably a tester valve of the annulus pressure operated type such as that disclosed in U.S. Pat. No. 3,856,085. Preferably, immediately above the tester valve 25 is located the sampler apparatus 50 of the present invention, although the sampler apparatus 50 may be installed at any position in the testing string 10 above the packer 27. Located immediately above the apparatus 50 of the present invention is circulation valve 30.

A pressure recording device 26 is located below the tester valve 25. The pressure recording device 26 is preferably one which provides a full opening passageway through the center of the pressure recorder to provide a full opening passageway through the entire length of the formation testing string.

It may be desirable to add additional formation testing apparatus in the testing string 10. For instance, where it is feared that the testing string 10 may become stuck in the borehole 3 it is desirable to add a jar mechanism between the pressure recorder 26 and the packer assembly 27. The jar mechanism is used to impart blows to the testing string to assist in jarring a stuck testing string loose from the borehole in the event that the testing string should become stuck. Additionally, it may be desirable to add a safety joint between the jar and the packer mechanism 27. Such a safety joint would allow for the testing string 10 to be disconnected from the packer assembly 27 in the event that the jarring mechanism was unable to free a stuck formation testing string.

The location of the pressure recording device may be varied as desired. For instance, the pressure recorder may be located below the perforated tail piece 28 in a suitable pressure recorder anchor shoe running case. In addition, a second pressure recorder may be run immediately above the tester valve 25 to provide further data to assist in evaluating the well.

Referring to FIGS. 2A through 2F, the annulus pressure responsive sample valve 50 of the present invention is shown.

In FIGS. 2A through 2F, the power section of sampler valve 50 comprises a shear ring assembly section 52 which includes upper or top adapter 54, shear case 56 and shear ring assembly 58, power case 122, and power mandrel 124 while the sampler section of the sampler valve 50 comprises latch nipple 180, sample case 220, closing sleeve 250, drain sleeve assembly 310 which includes drain sleeve 320, drain port protector 322 and set screws 324, drain nut assembly 312 which includes drain nut 360, a plurality of spherical balls 362 and drain plug 364, bottom nipple 314 and closing sleeve seal cover 316.

Figure 2A:
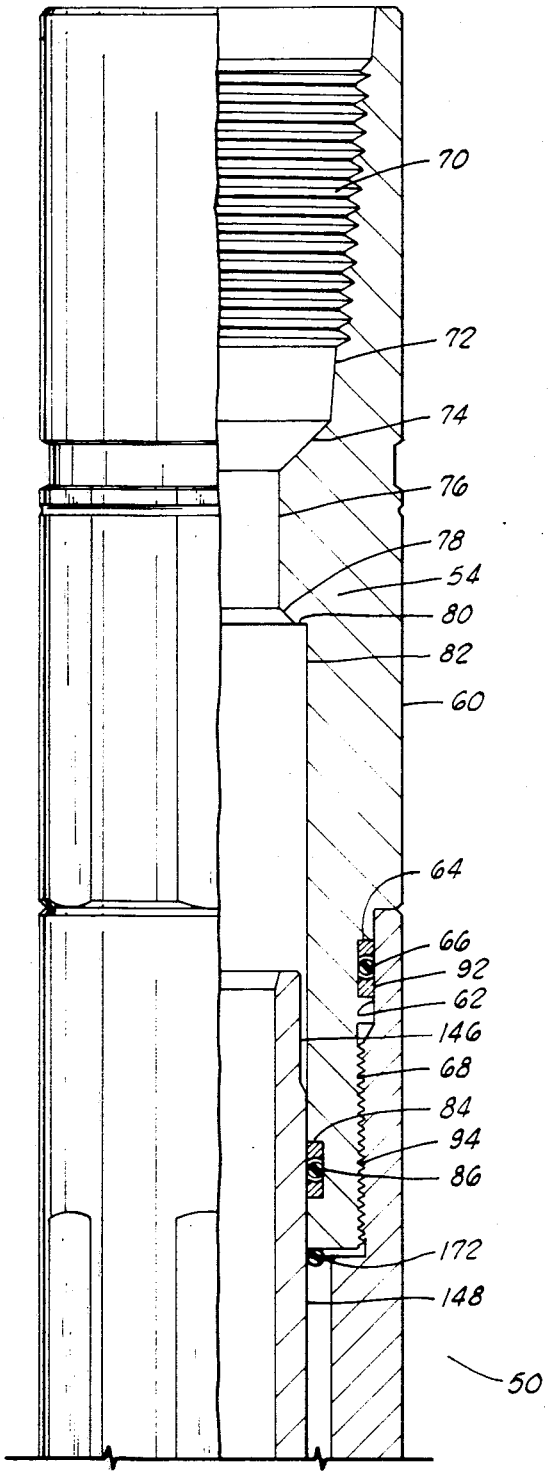
FIGS. 2A through 2F comprise a partial cross-sectional view of the present invention with the sample chamber open therein for fluid flow therethrough.
Figure 2B:
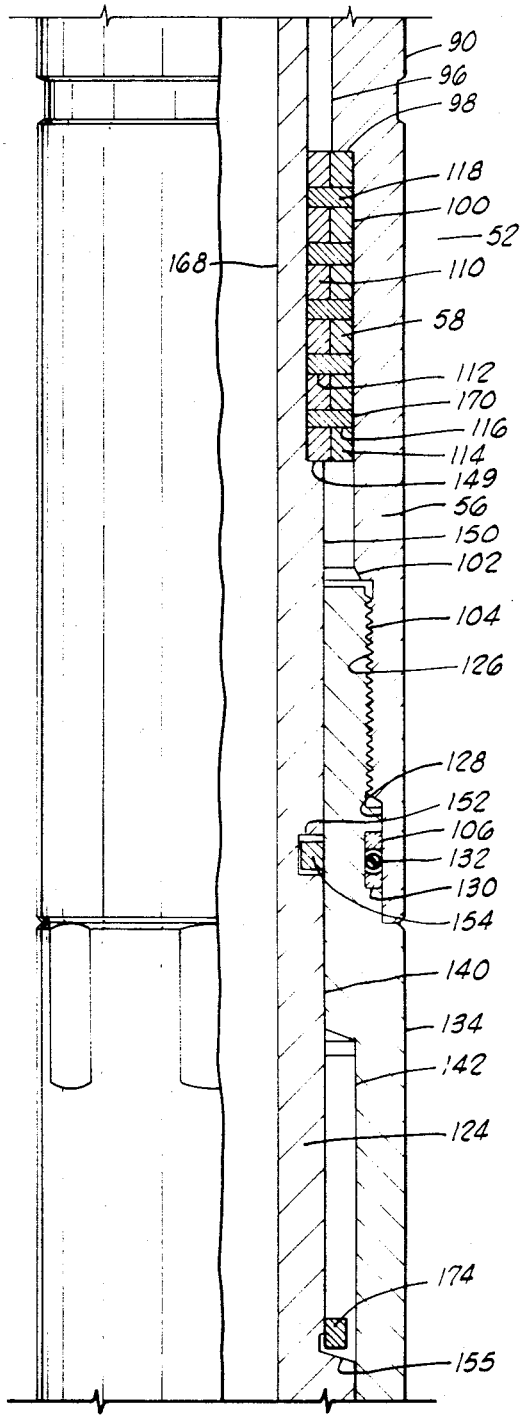

Referring to FIGS. 2A and 2B, the shear ring assembly section 52 of the sampler valve 50 is shown in partial cross-section. The shear ring assembly section 52 comprises upper or top adapter 54, shear case 56 and shear ring assembly 58.

The upper or top adapter 54 comprises an elongated, annular member having, on the exterior thereof, first cylindrical surface 60, second cylindrical surface 62 having, in turn, annular recess 64 therein containing seal means 66 therein, and threaded exterior surface 68 and, on the interior thereof, threaded bore 70, first frusto-conical bore 72, second frusto-conical bore 74, first cylindrical bore 76, third frusto-conical bore 78, annular shoulder 80, and second cylindrical bore 82 having, in turn, annular recess 84 therein containing seal means 86 therein.

The shear case 56 comprises an elongated, annular member having, on the exterior thereof, cylindrical surface 90 and, on the interior thereof, first cylindrical bore 92 which sealingly engages seal means 66 of the adapter 54, first threaded bore 94 which threadedly engages threaded exterior surface 68 of adapter 54, second cylindrical bore 96, annular shoulder 98, third cylindrical bore 100, frusto-conical surface 102, second threaded bore 104 and fourth cylindrical bore 106.

The shear ring assembly 58 comprises inner annular shear ring 110 having apertures 112 therein, outer annular shear ring 114 having apertures 116 therein, and a plurality of shear pins 118 retained within apertures 116 and 112 of the outer 114 and inner 110 shear rings respectively to releasably secure the annular shear rings 110 and 114 together.

Also shown in FIGS. 2A and 2B are portions of the power case 122 and power mandrel 124 of the power section assembly 120.

Regarding the power case 122, the threaded surface portion 126 releasably, threadedly engages second threaded bore 104 of shear case 56 while annular seal means 132 of case 122 sealingly engages fourth cylindrical bore 106 of shear case 56.

With respect to the power mandrel 124 the resilient annular lock ring 154 contained in annular recess 152 of third cylindrical surface 150 slidingly engages first cylindrical bore 140 of power case 122 while annular shoulder 149 of mandrel 124 abuts an end of inner shear ring 110 and second cylindrical surface 148 slidingly, sealingly engages annular seal means 86 contained in annular recess 84 in second cylindrical bore 82 of adapter 54.

As shown, when annular shoulder 149 of power mandrel 124 abuts an end of inner shear ring 110, annular shoulder 98 of shear case 56 abuts an end surface on the opposite end of outer shear ring 114 to retain the shear ring assembly 58 within annular cavity 170 formed between shear case 56 and power mandrel 124.

If desired, a resilient annular bumper 172 may be on the second cylindrical surface 148 of power mandrel 124 above shear ring assembly 58 to help prevent deformation of the end of adapter 54 when inner shear ring 110 impacts the same upon actuation of the sampler 50.

Figure 2C:
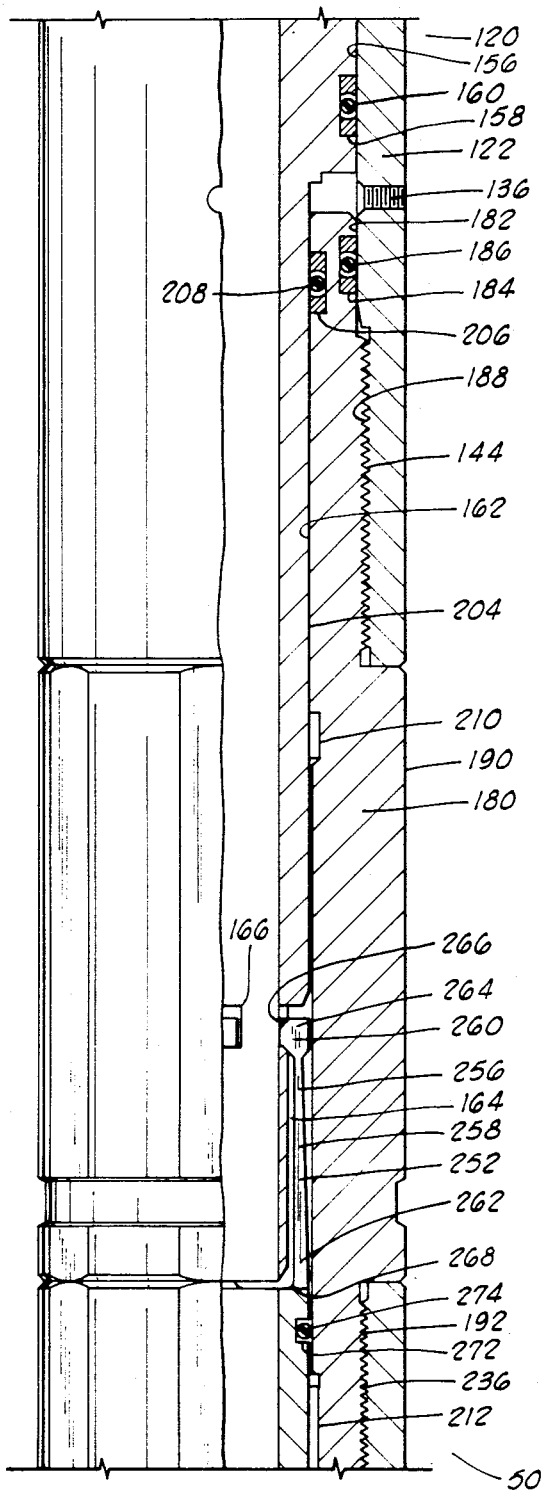

Referring to FIGS. 2A, 2B and 2C, the power case 122 and power mandrel 124 are shown.

The power case 122 comprises an elongated, annular member having, on the exterior thereof, threaded surface portion 126, first cylindrical surface portion 128 having, in turn, annular recess 130 therein containing annular seal means 132 therein, and second cylindrical surface portion 134 having in turn, a plurality of apertures 136 therein extending through to second cylindrical bore 142 and, on the interior thereof, first cylindrical bore 140, second cylindrical bore 142, and threaded bore 144.

The power mandrel 124 comprises an elongated, annular member having, on the exterior thereof, first cylindrical surface 146, second cylindrical surface 148, annular shoulder 149, third cylindrical surface 150 having, in turn, annular recess 152 therein containing resilient annular lock ring 154 therein, annular shoulder 155, fourth cylindrical surface 156 having, in turn, annular recess 158 therein containing annular seal means 160 therein, fifth cylindrical surface 162 and sixth cylindrical surface 164 having, in turn, a plurality of rectangular shaped apertures 166 therein and, on the interior thereof cylindrical bore 168.

Figure 2D:
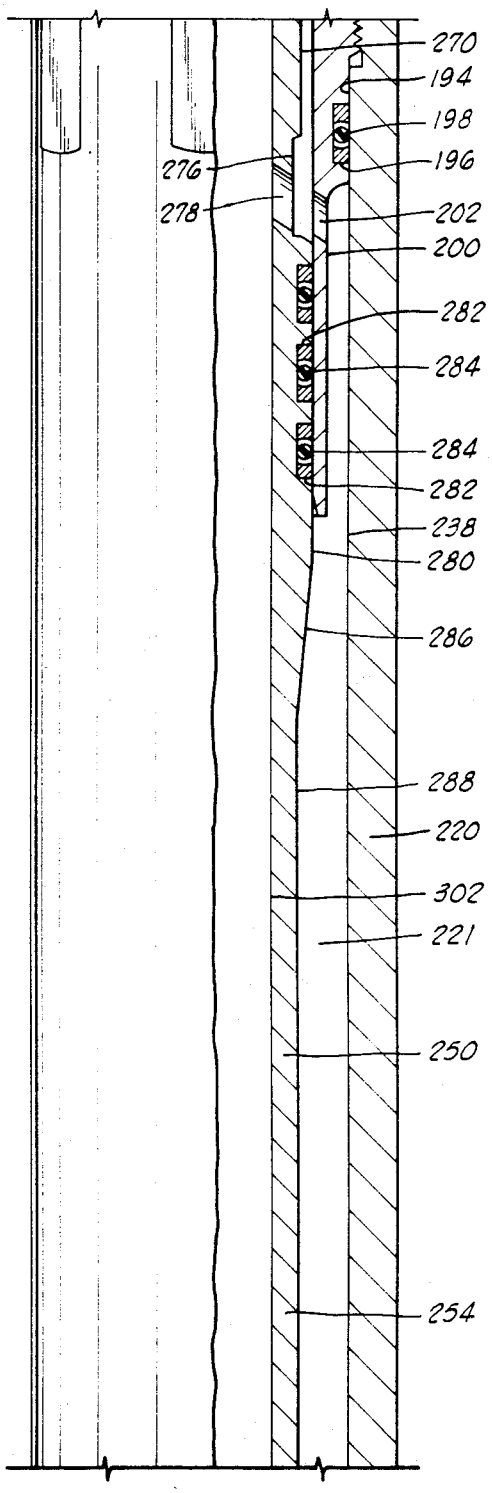

Further shown in FIGS. 2C and 2D are latch nipple 180, the upper portion of sample case 220 and the upper portion of closing sleeve 250.

The latch nipple 180 comprises an elongated annular member having, on the exterior thereof, first cylindrical surface 182 having, in turn, annular recess 184 therein containing annular seal means 186 therein which sealingly engages second cylindrical bore 142 of power case 122, first threaded annular surface 188 which releasably, threadedly engages threaded bore 144 of power case 122, second cylindrical surface 190, second threaded annular surface 192, third cylindrical surface 194 having, in turn, annular recess 196 therein containing seal means 198 therein and fourth cylindrical surface 200 having, in turn, a plurality of apertures 202 therein and, on the interior thereof, first cylindrical bore 204 having, in turn, annular recess 206 therein containing annular seal means 208 therein and annular recess 210 therein and second cylindrical bore 212 to which apertures 202 extend to allow fluid communication through latch nipple 180.

Regarding the upper portion of the sample case 250, threaded bore 236 releasably threadedly engages second threaded annular surface 192 of latch nipple 180 while first cylindrical bore 238 of case 250 sealingly engages annular seal means 198 in annular recess 196 of latch nipple 180.

With respect to the upper portion of closing sleeve 250, portions of the enlarged heads 264 of resilient members or fingers 256 are cammed into engagement with apertures 166 of power mandrel 124 releasably securing the closing sleeve 250 to the power mandrel 124 by portions of the enlarged heads 264 slidably engaging first cylindrical bore 204 of latch nipple 180 while annular seal means 274 in annular recess 272 of closing sleeve 250 slidably, sealingly engages first cylindrical bore 204 of latch nipple 180 and while annular seal means 284 contained in annular recesses 282 of closing sleeve 250 slidably, sealingly engage second cylindrical bore 212 of latch nipple 180.

Figure 2E:
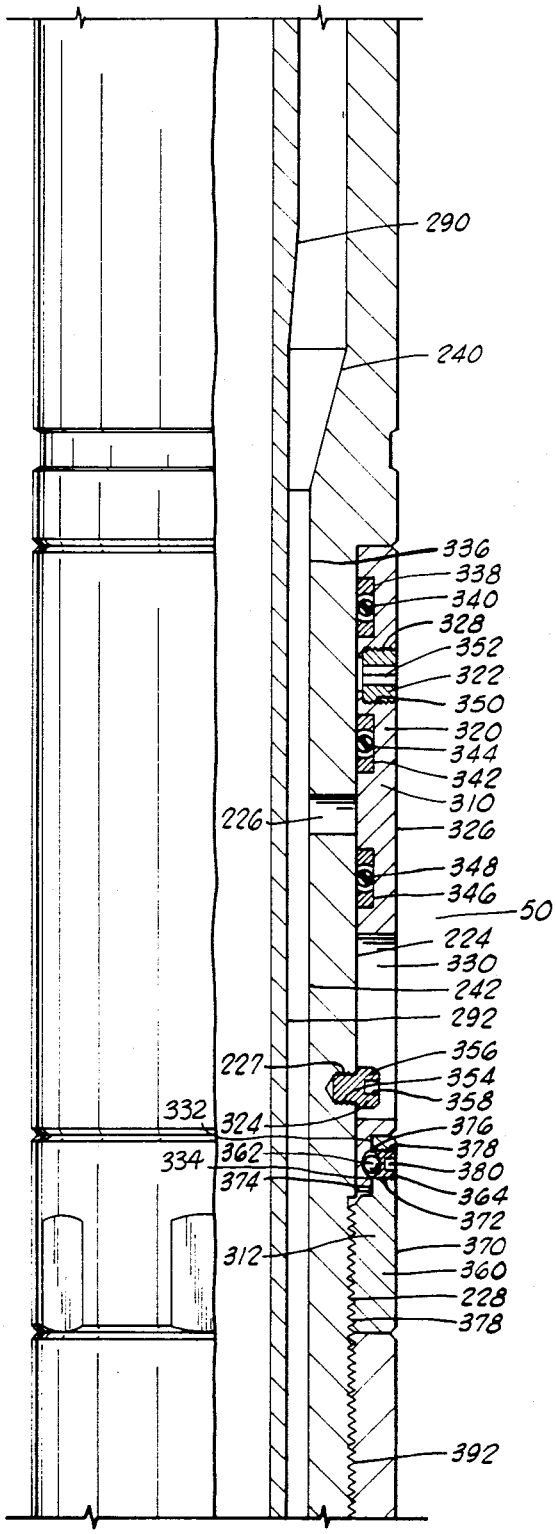

Referring to FIGS. 2D and 2E, the sample case 220 comprises an elongated, annular member having, on the exterior thereof, first cylindrical surface 222, second cylindrical surface 224 having, in turn, a plurality of apertures 226 therethrough, a plurality of threaded apertures 227 therein, threaded annular surface 228 and third cylindrical surface 230 having, in turn, annular recess 232 therein containing annular seal means 234 therein and, on the interior thereof, threaded bore 236, first cylindrical bore 238, frusto-conical surface 240, and second cylindrical bore 242.

The closing sleeve 250 comprises a latch portion 252 and sleeve portion 254.

The latch portion 252 comprises a plurality of resilient members or fingers 256, each member and finger 256 having an elongated, rectangular in cross-section shape body portion 258 having, in turn, on one end thereof an enlarged rectangular shaped head 264 having chamfered surfaces 166 thereon and the other end 262 thereof secured to the end 268 of sleeve portion 254.

The sleeve portion 254 comprises an elongated, annular member having, on the exterior thereof, first cylindrical surface 270 having, in turn, annular recess 272 therein containing annular seal means 274 therein, second cylindrical surface 276 having, in turn, a plurality of apertures 278 therein, third cylindrical surface 280 having, in turn, a plurality of annular recesses 282 therein, each recess 282 containing annular seal means 284 therein, first frusto-conical surface 286, fourth cylindrical surface 288, second frusto-conical surface 290, fifth cylindrical surface 292, sixth cylindrical surface 294 having, in turn, a plurality of annular recesses 296 therein, each recess 296 containing an annular seal means 298 therein, and third frusto-conical surface 300 and, on the interior thereof, cylindrical bore 302 having, in turn, apertures 278 terminating therein to allow fluid communication from the exterior to the interior of the sleeve portion 254 closing sleeve 250.

Figure 2F:
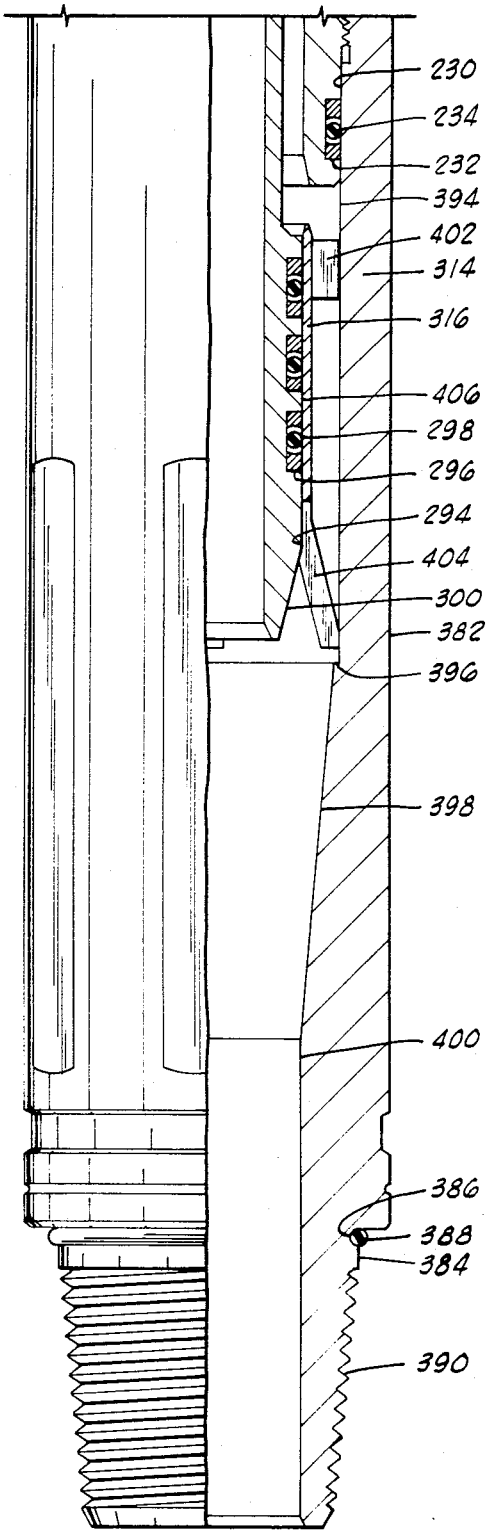

Referring to FIGS. 2E and 2F, the drain sleeve assembly 310, drain nut assembly 312, bottom nipple 314 and sleeve seal cover 316 are shown.

The drain sleeve assembly 310 comprises drain sleeve 320, drain port protector 322 and set screws 324.

The drain sleeve 320 comprises an annular member having, on the exterior thereof, first cylindrical surface 326 having, in turn, threaded apertures 328 therethrough and a plurality of elongated, rectangular in shape apertures 330 therethrough and second cylindrical surface 332 having, in turn, an annular semi-circular in cross-section recess 334 therein and, on the interior thereof, cylindrical bore 336 having, in turn, a first annular recess 338 containing annular seal means 340 therein located on one side of threaded aperture 328, a second annular recess 342 containing annular seal means 344 therein located on the other side of threaded aperture 328 and a third annular recess 346 containing annular seal means 348 therein located adjacent one end of aperture 330 and a distance from annular recess 342 greater than the diameter of aperture 226 in sample case 220 such that when drain sleeve 320 is located in a first position on sample case 220 the annular seal means 344 and 348 in second 342 and third 346 annular recesses respectively slidingly sealing engage the second cylindrical surface 224 to prevent fluid flow through aperture 226.

The drain port protector 322 comprises a threaded cylindrical member having threaded surface 350 thereon which releasably, threadedly engages threaded aperture 328 in drain sleeve 320 and polygonal shaped, in cross-section, aperture 352 therein.

Each set screw 324 comprises a cylindrical member having a threaded portion 354 which releasably, threadedly engages threaded aperture 227 in sample case 224 and a head portion 356 having, in turn, a polygonal shaped, in cross-section, aperture 358 therein.

The drain nut assembly 312 comprises drain nut 360, a plurality of spherical balls 362 and drain plug 364.

The drain nut 360 comprises an annular member having, on the exterior thereof, cylindrical surface 370 having, in turn, threaded aperture 372 therein and on, the interior thereof, cylindrical surface 374 having, in turn, annular, semi-circular in cross-section recess 376 therein and threaded bore 378 which releasably, threadedly engages threaded surface 228 of sample case 220.

Each spherical ball 362 comprises a spherical member having a diameter which is compatible with the semi-circular in cross-section annular recesses 376 and 334 in drain nut 360 and drain sleeve 320 respectively to effectively form a roller bearing assembly when the drain sleeve 320 and drain nut are in an assembled relationship.

The drain plug 364 comprises a cylindrical member having a threaded exterior 378 and polygonal shaped recess 380 therein.

The bottom nipple 314 comprises an elongated annular member having, on the exterior thereof, cylindrical surface 382, cylindrical surface 384 having, in turn, annular recess 386 therein containing annular seal means 388 therein, and threaded exterior portion 390 and, on the interior thereof, threaded bore 392, cylindrical bore 394, annular shoulder 396, frusto-conical bore 398 and cylindrical bore 400.

The closing sleeve seal cover 316 comprises an annular member having, on the exterior thereof, a plurality of rectangular shaped forward centering guides 402 whose outer edges abut bore 394 of bottom nipple 314 and a plurality of rear centering guides 404 whose outer edges abut bore 394 of bottom nipple 314 and, on the interior thereof, bore 406 which slidingly, sealingly engages sixth cylindrical surface 294 and seal means 298 of the sleeve portion 254 of closing sleeve 250. When installed in the sampler valve 50, the closing sleeve seal cover 316 centers the lower end portion of closing sleeve 250 within bottom nipple 314.

Figure 3A:
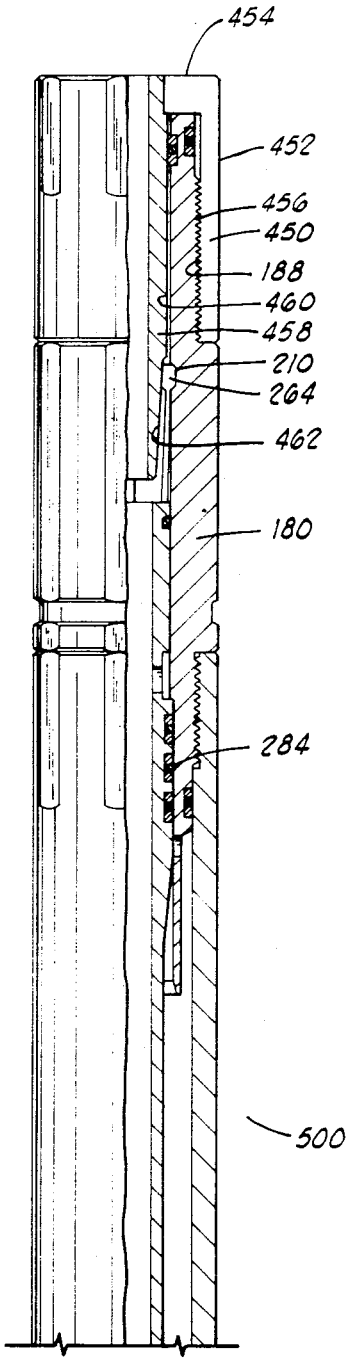
FIGS. 3A and 3B comprises a partial cross-sectional view of a portion of the present invention wherein the sample chamber is secured for transport from the drilling rig floor.
Figure 3B:
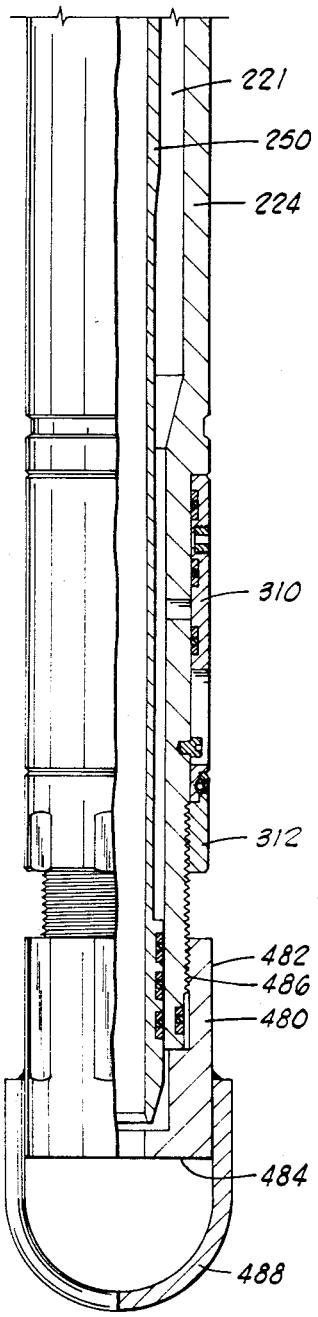

Referring to FIGS. 3A and 3B, a portion of the 500 sampler valve 50 is shown in position for the retention and transportation of a fluid sample from a formation. As shown, the trapped fluid sample is retained within the portion 500 of the sampler valve 50 comprised by sample case 224, sample sleeve 250, latch nipple 180, drain sleeve assembly 310, drain nut assembly 312, upper transport cap 450 and lower transport cap 480.

The upper transport cap 450 comprises an annular member having a cylindrical exterior surface 452, annular end 454, threaded bore 456 which releasably threadedly engages first threaded annular surface 188 of latch nipple 180, closing sleeve latch retainer 458 centrally located in the upper transport cap 450 having, in turn, one end thereof to annular end 454, a cylindrical surface portion 460 which slidingly sealingly engaged annular seal means 208 in latch nipple 180, and a frusto-conical surface portion 462 which slidingly engages enlarged heads 264 of fingers 256 of latch portion 252 of closing sleeve 250.

The lower transport cap 480 comprises an annular member having a cylindrical exterior surface 482, annular end 484, threaded bore 486 which releasably threadedly engages annular threaded surface 228 of sample sleeve 220 and carrying member 488.

As shown, when the transport portion 500 of the sampler valve 50 is ready for transport, the sample of fluid is retained within annular chamber 221 formed between the sample case 220 and closing sleeve 250 by annular seal means 284 of closing sleeve 250 sealingly engaging second cylindrical bore 212 of latch nipple 180 and annular seal means 298 of closing sleeve 250 sealingly engaging second cylindrical 242 of sample case 220 while enlarged heads 264 of fingers 256 of latch portion 252 of closing sleeve 250 engage annular recess 210 of latch nipple 180 to retain the closing sleeve 250 in its sample trapping position.

OPERATION OF THE SAMPLER VALVE

Referring to FIGS. 1 and 2A through 2F, and 3 when the sampler valve 50 is run into the well bore 3 as part of the test string 10, the sampler valve 50 is in the open position shown in FIGS. 2A through 2F.

During testing of the formation 5, fluids from the formation 5 will flow through sampler valve 50 with a portion of the fluid flowing through bores 398 and 400 of bottom nipple 314 flowing through bore 302 of closing sleeve 250 while a portion of the fluid flows around closing sleeve 250 into annular chamber 221 back into bore 302 of closing sleeve 250 via apertures 202 in latch nipple 180 and 278 in closing sleeve 250.

To actuate the sampler valve 50 to trap a sample of the fluids from the formation 5, fluid pressure is increased in the well annulus 16 which causes the fluid pressure from the well bore communicating through apertures 136 acting across the annular surface formed between fourth cylindrical surface 156 and fifth cylindrical surface of power mandrel 124 to similarly increase.

When the fluid pressure in the well annulus 16 has increased sufficiently, the force acting on power mandrel 124 will cause the shear pins 118 in the shear ring assembly 58 to shear thereby allowing the power mandrel 124 to move upwardly in the sampler valve 50.

As the power mandrel 124 moves upwardly in sampler valve 50, since closing sleeve 250 has the enlarged heads 264 of fingers 256 of latch portion 252 cammed into engagement with apertures 166 of power mandrel 124 by bore 204 of latch nipple 180, closing sleeve 250 is moved upwardly within sampler valve 50 with the power mandrel 124. The power mandrel 124 moves upwardly in the sampler valve 50 until annular shoulder 155 of power mandrel 124 abuts resilient annular bumper 174 which, in turn, abuts annular shoulder 141 of power case 122 and the upper end of shear ring 110 of shear ring assembly 58 abuts resilient bumper 172 which, in turn, abuts the lower end of the upper or top adapter 54.

During the upward movement of the power mandrel 124 the closing sleeve 250 moves therewith until the enlarged heads 264 of fingers 256 of latch portion 252 spring into engagement with annular recess 210 in latch nipple 180 thereby releasing the closing sleeve 250 from further movement with power mandrel 124 and resiliently, releasably, locking closing sleeve 250 in a closed position within sampler valve 50 wherein apertures 278 in closing sleeve 250 are no longer in alignment with apertures 202 in latch nipple 180 so that annular seal means 284 of closing sleeve 250 sealingly engage second cylindrical bore 212 of latch nipple 180 and annular seal means 298 of closing sleeve 250 sealingly engage second cylindrical bore 242 of sample case 220 to trap a sample of the fluid from the formation 5 within annular chamber 221 formed between sample case 220 and closing sleeve 250. When the power mandrel 124 has moved past the upper end surface of power case 122, resilient annular lock ring 154 springs partially outwardly into annular chamber 170 thereby preventing any subsequent downward movement of the power mandrel 124 within sampler valve 50 such that the downward movement of the power mandrel 124 would cause the enlarged heads 264 of fingers 256 of latch portion 252 of closing sleeve 250 to disengage annular recess 210 of latch nipple 180.

After trapping of a fluid sample from the formation 5 in the sampler valve 50, if desired, fluids may be pumped through the unrestricted bore of the sampler valve 50 back down into the formation 5 without contaminating the fluid sample retained within annular chamber 221 of the sampler valve 50.

After a sample has been trapped within sampler valve 50 and any subsequent testing or fluid pumping operations have been completed, the test string 10 is removed from the well bore 3 and the sampler valve 50 removed therefrom. At this time, if desired, the upper top adapter 54, shear case 56, shear ring assembly 58, power case 122, and power mandrel 124 are removed from latch nipple 180 by threadedly disengaging threaded bore 144 of power case 122 from first threaded annular surface 188 of latch nipple 180 and upper transport cap 450 is threadedly, releasably secured to latch nipple 180 via first threaded annular surface 188. In conjunction, at this time, bottom nipple 314 and sleeve seal cover 316 are removed from sampler valve 50 by threadedly disengaging threaded bore 392 of bottom nipple 314 from annular threaded surface 228 of sample case 220 and, lower transport cap 480 is threadedly, releasably secured to sample case 220 via annular threaded surface 228.

After the sampler valve 50 has been partially disassembled and the transport cap 450 and 480 assembled on the remaining disassembled portions of the sampler valve 50 as described above to form portion 500 of the sampler valve 50 (see FIGS. 3A and 3B), the remaining transport portion 500 is ready for transport of the fluid sample retained in annular chamber 221 off the drilling rig floor to be transferred to an approved chamber for transportation to the laboratory for analysis.

With the transport caps 450 and 480 secured to transport portion 500 of the sampler valve 50, closing sleeve 250 is prevented from movement in latch nipple 180 and sample case 220 by closing sleeve latch retaining 458 of cap 450 camming enlarged heads 264 of fingers 256 of latch portion 252 of closing sleeve 250 into annular recess 210 of latch nipple 180 while annular end 484 of cap 480 also prevents movement of the closing sleeve 250 if closing sleeve 250 would become disengaged from latch nipple 180.

To remove the fluid sample in annular chamber 221 of transport portion 500 of sampler valve 50, after transport cap 480 has been removed from transport portion 500 drain port protector 322 is removed from aperture 328 in drain sleeve 320 and a suitable line connected thereto.

Next, drain nut 312 is rotated on annular threaded surface 228 of sample case 220 to cause movement of the drain nut 312 towards the end of sample case 220. With the movement of drain nut 312 on sample case 220 since drain sleeve 320 of drain sleeve assembly 310 is connected thereto via spherical balls 362, drain sleeve 320 advances therewith along sample case 220 until aperture 328 aligns with aperture 226 in sample case 220 thereby allowing fluid communication between the line connected to aperture 328 in drain sleeve 320 and annular chamber 221 containing the fluid sample from the formation 5.

It will be seen from the foregoing description of the invention that the sampler valve of the present invention can be used in trapping sample fluids from formations, for allowing fluids to be pumped through the unrestricted bore of the sampler valve after the trapping of a formation fluid sample and for the transfer to an approved chamber for transportation of the formation fluid sample to the laboratory for analysis.

Having thus described my invention, I claim:

1. An apparatus for use in a test string in a well and adapted to trap and retain a fluid sample from a formation in said well, said apparatus comprising:

a power section assembly, the power section assembly including:

a shear ring assembly section;

a power case connected to the shear ring assembly section, the power case having a plurality of apertures therein to allow fluid communication from the exterior to the interior thereof; and a power mandrel slidably disposed within a portion of said apparatus, the power mandrel having a portion of the exterior thereof in fluid communication with the apertures in the power case and a portion thereof abutting a portion of the shear ring assembly; and a sampler section assembly, the sampler section assembly including:

a latch nipple connected to the power case;

a sample case, the sample case connected to the latch nipple, and having an aperture therein;

a drain sleeve assembly slidably, sealingly, located on the exterior of the sample case;

a bottom nipple connected to the sample case, the bottom nipple having one end thereof adapted for connecting said apparatus to said test string and a bore therethrough; and a closing sleeve slidably disposed within said apparatus releasably secured to the power mandrel, the closing sleeve operably movable between a first open position allowing said fluid from said formation in said well to flow therethrough and thereround and a second closed position allowing said fluid from said formation in said well to only flow therethrough whereby an annular fluid sample chamber is formed between the sample case and the closing sleeve in said apparatus in which an amount of said fluid from said formation in said well may be trapped and retained when the closing sleeve moves from the first position to the second position in said apparatus, said apparatus having an open unrestricted full bore therethrough before and after an amount of said fluid from said formation in said well is trapped and retained in said apparatus.

2. The apparatus of claim 1 wherein the sampler section assembly further includes:

a drain nut assembly located on the exterior of the sample case releasably secured to a portion of the drain sleeve assembly.

3. The apparatus of claim 2 wherein the sampler section further includes:

a closing sleeve seal cover contained within the bottom nipple and having a portion of the sleeve portion of the closing sleeve slidably disposed therein.

4. A well sampling apparatus for use in a test string in a well and adapted to trap and retain a fluid sample from a formation in said well, said apparatus comprising:

a power section assembly, the power section assembly including:

a shear ring assembly section;

a power case connected to the shear ring assembly section, the power case having a plurality of apertures therein to allow fluid communication from the exterior to the interior thereof; and a power mandrel slidably disposed within a portion of said apparatus, the power mandrel having a portion of the exterior thereof in fluid communication with the apertures in the power case and a portion thereof abutting a portion of the shear ring assembly; and a sampler section assembly, the sampler section assembly including:

a latch nipple connected to the power case;

a sample case, the sample case connected to the latch nipple, and having an aperture therein;

a drain sleeve assembly slidably, sealingly, located on the exterior of the sample case;

a drain nut assembly located on the exterior of the sample case releasably secured to a portion of the drain sleeve assembly;

a bottom nipple connected to the sample case, the bottom nipple having one end thereof adapted for connecting said apparatus to said test string and a bore therethrough;

a closing sleeve slidably disposed within said apparatus releasably secured to the power mandrel, the closing sleeve operably movable between a first open position allowing said fluid from said formation in said well to flow therethrough and thereround and a second closed position allowing said fluid from said formation in said well to only flow therethrough; and a closing sleeve seal cover contained within the bottom nipple and having a portion of the sleeve portion of the closing sleeve slidably disposed therein whereby an annular fluid sample chamber is formed between the sample case and the closing sleeve in said apparatus in which an amount of said fluid from said formation in said well may be trapped and retained when the closing sleeve moves from the first position to the second position in said apparatus, said apparatus having an open unrestricted full bore therethrough before and after an amount of said fluid from said formation in said well is trapped and retained in said apparatus.

5. The apparatus of claim 4 wherein the shear ring assembly section comprises:

an adapter for connecting said apparatus to said test string;

a shear ring assembly for controlling the initial actuation of said apparatus; and a shear case connected to the adapter for containing the shear ring assembly therein.

6. The apparatus of claim 5 wherein the drain sleeve assembly comprises:

a drain sleeve slidably, sealingly located on the exterior of the sample case, the drain sleeve having a drain port therein an aperture therein, and an annular recess in the exterior thereof adjacent one end thereof;

a drain port protector releasably secured in the drain port in the drain sleeve; and a drain sleeve set screw secured to the sample case having a portion thereof slidably received within the aperture in the drain sleeve.

7. The apparatus of claim 6 wherein the drain nut assembly comprises:

a drain nut located on the exterior of the sample case, the drain nut having an annular recess in a bore thereof adjacent one end thereof and an aperture therein communicating with the annular recess in the bore adjacent one end thereof;

a plurality of balls located in the annular recess in the bore adjacent one end of the drain nut and the annular recess in the exterior of the drain sleeve adjacent one end thereof, the balls rotatably securing the drain sleeve to the drain nut; and a drain plug secured within the aperture in the drain nut to prevent the release of the balls from the annular recesses in the drain sleeve and drain nut.

8. The apparatus of claim 7 wherein the closing sleeve comprises:

a latch portion for releasably securing the closing sleeve to the power mandrel; and a sleeve portion for forming an annular chamber between the interior of the sample case and the exterior of a portion of the closing sleeve.

9. The apparatus of claim 8 wherein the shear ring assembly comprises:

an inner annular shear ring having a plurality of apertures therein;

an outer annular shear ring having a plurality of apertures therein; and a plurality of shear pins extending through the plurality of apertures in the outer annular shear ring and the plurality of apertures in the inner annular shear ring.

10. The apparatus of claim 9 wherein the closing sleeve seal cover comprises:

an annular member having, on the exterior thereof, a plurality of forward centering guides having, in turn, their outer edges abutting the bore of the bottom nipple and a plurality of rear centering guides having, in turn, their outer edges abutting the bore of the bottom nipple and, on the interior thereof, a bore which slidingly, sealingly engages a portion of the sleeve portion of the closing sleeve.

11. The apparatus of claim 10 wherein the latch nipple includes a bore therethrough, the bore having an annular recess therein adapted to receive a portion of the latch portion of the closing sleeve therein upon actuation of said apparatus.

12. The apparatus of claim 11 wherein the latch portion of the closing sleeve comprises:

a plurality of resilient members, each member having an elongated body portion having, in turn, one end secured to the sleeve portion of the closing sleeve and on the other end thereof an enlarged head adapted to be received in the annular recess in the bore of the latch nipple.

13. The apparatus of claim 12 wherein the power mandrel including a bore therethrough and a plurality of apertures therein adjacent one end thereof, each aperture adapted to receive a portion of an enlarged head of a resilient member of the latch portion of the closing sleeve.

14. A pressure responsive fluid sampling apparatus for use in a test string in a well and adapted to trap and retain a fluid sample from a formation in said well, said apparatus comprising:

a power section assembly, the power section assembly including:

a shear ring assembly section, the shear ring assembly section comprising:

an adapter for connecting said apparatus to said test string;

a shear ring assembly for controlling the initial actuation of said apparatus; and a shear case connected to the adapter for containing the shear ring assembly therein;

a power case connected to the shear case, the power case having a plurality of apertures therein to allow fluid communication from the exterior to the interior thereof; and a power mandrel slidably disposed within a portion of said apparatus, the power mandrel having a portion of the exterior thereof in fluid communication with the apertures in the power case and a portion thereof abutting a portion of the shear ring assembly; and a sampler section assembly, the sampler section assembly including:

a latch nipple connected to the power case;

a sample case, the sample case connected to the latch nipple, and having an aperture therein;

a drain sleeve assembly slidably, sealingly located on the exterior of the sample case, the drain sleeve assembly comprising:

a drain sleeve assembly slidably, sealingly, located on the exterior of the sample case, the drain sleeve having a drain port therein an aperature therein, and an annular recess in the exterior thereof adjacent one end thereof;

a drain port protector releasably secured in the drain port in the drain sleeve; and a drain sleeve set screw secured to the sample case having a portion thereof slidably received within the aperture in the drain sleeve;

a drain nut assembly releasably secured to a portion of the drain sleeve assembly located on the exterior of the sample case, the drain nut assembly comprising:

a drain nut located on the exterior of the sample case, the drain nut having an annular recess in a bore thereof adjacent one end thereof and an aperture therein communicating with the annular recess in the bore adjacent one end thereof;

a plurality of balls located in the annular recess in the bore adjacent one end of the drain nut and the annular recess in the exterior of the drain sleeve adjacent one end thereof, the balls rotatably securing the drain sleeve to the drain nut; and a drain plug secured within the aperture in the drain nut to prevent the release of the balls from the annular recesses in the drain sleeve and drain nut;

a bottom nipple connected to the sample case, the bottom nipple having one end thereof adapted for connecting said apparatus to said test string and a bore therethrough;

a closing sleeve slidably disposed within said apparatus releasably secured to the power mandrel, the closing sleeve operably movable between a first open position allowing said fluid from said formation in said well to flow therethrough and thereafound and a second closed position allowing said fluid from said formation in said well to only flow therethrough, the closing sleeve including:

a latch portion for releasably securing the closing sleeve to the power mandrel; and a sleeve portion for forming an annular sample chamber between the interior of the sample case and the exterior of a portion of the closing sleeve; and a closing sleeve seal cover contained within the bottom nipple and having a portion of the sleeve portion of the closing sleeve slidably disposed therein whereby an annular sample chamber is formed between the sample case and the closing sleeve in said apparatus in which an amount of said fluid from said formation in said well may be trapped and retained when the closing sleeve moves from the first position to the second position in said apparatus, said apparatus having an open unrestricted full bore therethrough before and after an amount of said fluid from said formation in said well is trapped and retained in said apparatus.

15. The apparatus of claim 14 wherein the shear ring assembly comprises:

an inner annular shear ring having a plurality of apertures therein;

an outer annular shear ring having a plurality of apertures therein; and a plurality of shear pins extending through the plurality of apertures in the outer annular shear ring and the plurality of apertures in the inner annular shear ring.

16. The apparatus of claim 15 wherein the closing sleeve seal cover comprises:

an annular member having, on the exterior thereof, a plurality of forward centering guides having, in turn, their outer edges abutting the bore of the bottom nipple and a plurality of rear centering guides having, in turn, their outer edges abutting the bore of the bottom nipple and, on the interior thereof, a bore which slidingly, sealingly engages a portion of the sleeve portion of the closing sleeve.

17. The apparatus of claim 16 wherein the latch nipple includes a bore therethrough, the bore having an annular recess therein adapted to receive a portion of the latch portion of the closing sleeve therein upon actuation of said apparatus.

18. The apparatus of claim 17 wherein the latch portion of the closing sleeve comprises:

a plurality of resilient members, each member having an elongated body portion having, in turn, one end secured to the sleeve portion of the closing sleeve and on the other end thereof an enlarged head adapted to be received in the annular recess in the bore of the latch nipple.

19. The apparatus of claim 18 wherein the power mandrel including a bore therethrough and a plurality of apertures therein adjacent one end thereof, each aperture adapted to receive a portion of an enlarged head of a resilient member of the latch portion of the closing sleeve.

* * * * *

UNITED STATES PATENT AND TRADEMARK OFFICE

CERTIFICATE OF CORRECTION

PATENT NO. : 4,502,537

DATED : March 5, 1985

INVENTOR(S) : Ernest E. Carter, Jr.

It is certified that error appears in the above-identified patent and that said Letters Patent is hereby corrected as shown below:

In column 3, line 18, delete the word [wall] and insert therefor --well--.

In column 6, line 38, delete the numeral [166] and insert therefor --266--.

In column 11, line 20, following the word "section" insert the word --assembly--.

Signed and Sealed this

*Third* Day of *September 1985*

[SEAL]

*Attest:*

DONALD J. QUIGG

*Attesting Officer* *Acting Commissioner of Patents and Trademarks - Designate*